US007204966B2

(12) United States Patent
Garg

(10) Patent No.: US 7,204,966 B2
(45) Date of Patent: Apr. 17, 2007

(54) METHOD AND APPARATUS FOR IMPROVED FIRED HEATERS

(76) Inventor: Ashutosh Garg, 5303 April Run Ct., Sugar Land, TX (US) 77479

( * ) Notice: Subject to any disclaimer, the term of this patent is extended or adjusted under 35 U.S.C. 154(b) by 478 days.

(21) Appl. No.: 10/290,830

(22) Filed: Nov. 8, 2002

(65) Prior Publication Data

US 2004/0089588 A1 May 13, 2004

(51) Int. Cl.
*B01J 19/00* (2006.01)
*F28D 7/00* (2006.01)
*F22B 21/00* (2006.01)

(52) U.S. Cl. ..... 422/198; 422/200; 122/250 R; 122/184; 122/7 R; 122/470; 431/328; 432/26

(58) Field of Classification Search ..... 122/250 R, 122/184 D, 7 R, 470; 165/110; 431/328; 432/26; 208/134; 422/198, 200
See application file for complete search history.

(56) References Cited

U.S. PATENT DOCUMENTS 4,409,095 A * 10/1983 Peters ..... 208/134
4,422,411 A * 12/1983 Thorogood ..... 122/7 R
4,431,522 A * 2/1984 James, Jr. ..... 208/134
4,494,485 A * 1/1985 Kendall et al. ..... 122/250 R
4,986,222 A * 1/1991 Pickell et al. ..... 122/6 R
5,247,907 A * 9/1993 Lee et al. ..... 122/1 R
5,437,247 A * 8/1995 Dubil et al. ..... 122/44.2
5,878,699 A * 3/1999 Barnett et al. ..... 122/1 A
6,178,926 B1 1/2001 Worman
6,237,545 B1 5/2001 Barnett

OTHER PUBLICATIONS

Chapter 1 of the user manual of FRNC-5 Computer Program.

* cited by examiner

*Primary Examiner*—N. Bhat
(74) *Attorney, Agent, or Firm*—Harish Dhingra; Dhingra & Associates

(57) ABSTRACT

A fired heater is adapted for increasing the output of a plant where the furnace capacity is considerably improved without corresponding increase in the pressure drop. The described technique utilizes a parallel thermal path in contrast to the conventional series thermal path for heating a hydrocarbon fluid. The fluid is divided into at least two paths where the fluid in the first path is heated primarily by radiation heat transfer mechanism and the fluid in the second path is heated primarily by convection heat transfer mechanism. The at least two fluid streams may then be combined to continue with other desired processing of the fluid.

23 Claims, 4 Drawing Sheets

METHOD AND APPARATUS FOR IMPROVED FIRED HEATERS

CROSS-REFERENCE TO RELATED APPLICATIONS

Not Applicable.

Statements Regarding Federally Sponsored Research or Development

Not Applicable.

Reference to a Microfiche Appendix

Not Applicable.

BACKGROUND OF THE INVENTION

1. Field of the Invention

This invention relates to fired heaters, also known as process furnaces, and more specifically to fired heaters used in processing hydrocarbons.

2. Description of the Related Art

Typical fired heaters are designed to heat hydrocarbons. Numerous processes on hydrocarbons are carried out in furnaces commonly known as fired heaters, or process furnaces, or fired heater furnaces, pipe stills.

Fired heaters are equipment in which fluid is heated to high temperatures by burning fuel gas or fuel oil in a combustion chamber. The tubes carrying the fluid are located in the center or on sides in the combustion chamber. The combustion chamber is lined with refractory material. The hot flue gases in the vicinity of the burners transmit heat to the fluid feed primarily by radiant heat transfer mechanism. This part of the heater is known as the radiant section or firebox section. The flue gases leaving the radiant section are typically at 1400–1800° F. and more heat can be recovered from these gases. Additional heat is recovered in the convection section where the flue gases are cooled by exchanging the heat with the fluid. In heaters, fluid generally enters the convection section first and then flows through the radiant section to maximize the heat recovery. In some heaters, process fluid enters through the radiant section and leaves through the radiant section. In these heaters, heat in the convection section is recovered by generating steam or preheating other hydrocarbon services. Flue gases are disposed off to the atmosphere through a stack.

Most refineries possess catalytic reforming units. In these catalytic reforming units, a hydrocarbon, for example, light petroleum distillate (naphtha) is contacted with platinum catalyst at elevated temperature and pressure. This process produces high-octane liquid product that is rich in aromatic compounds. The process upgrades low octane number straight run naphtha to high-octane motor fuels. In a typical unit, the feed to the unit is mixed with recycle hydrogen gas and it is heated first in heat exchangers and then in a fired heater. The feed is then sent to a reactor. Most reactions that occur in the reactor are endothermic reactions and occur in stages. The reactors are separated into several stages. Inter stage heaters may be installed between the reaction stages to maintain the desired temperature of the hydrocarbon feed.

Refineries have been de-bottlenecking their units to improve the fired heater capacity and improve thermal efficiency of the system. FIG. 1 illustrates the commonly practiced concept of the technique (prior art) used for heating the feed. A typical existing unit 100 comprises a convection section 120 and a radiant section 150. The feed is first sent to the convection section 120 through a plurality of fluid passes 122, 124, 126, 128, and 130, comprising fluid oath 135 for example. The preheated fluid then enters the radiant section 150 where it is heated further and the fluid exits through a fluid exit path 140. The fluid exiting the fluid path 140 may then be further passed through a series of concatenated fired heaters similar to the fired heater system 100.

Alternatively, the fluid may be introduced directly into the radiant section or in the convection section. Typically, when the fluid is directly introduced in the radiant section, a significant a mount of heat energy remains in the flue gases. A portion of this remaining energy may be recovered in the convection section by generating steam, preheating combustion air, or preheating other streams. Often times the refiners do not need the steam and they do not have other attractive choices.

In such fired u nits, the feed consists of hydrocarbon vapors and recycle hydrogen gas. The feed in vapor form has a very large volume and pressure drop across the heater is very important. Low-pressure drop minimizes recycle gas compressor differential pressure and the necessary compressor horsepower. The result is lower utility consumption. Low-pressure drop also permits operation at lowest reactor pressure. As a result, the heaters are designed as all radiant heaters with large manifolds at the inlets and outlets. Convection sections are typically used for steam generation or other waste heat recovery operations. Often times, the byproducts of waste heat recovery are not needed, and the heat is discharged in to the atmosphere.

BRIEF SUMMARY OF THE INVENTION

Exemplary techniques for heating hydrocarbon fluids in fired heaters are illustrated in which the fluid is divided into at least two fluid paths. The fluid in the first path is heated by predominantly one heat transfer mechanism and the fluid in the second path is heated by predominantly a second heat transfer mechanism. Thus, effectively, the technique provides for parallel heat transfer paths.

A fired heater furnace is adapted for processing hydrocarbons fluids such that the fluid path is divided into a plurality of paths. The fluid in each path is heated by predominantly different heat transfer mechanisms. After heating the fluids in different heating paths, the fluids are combined. The combined fluid may again be heated in a furnace coupled to the first furnace. Alternately, the combined fluid may be processed in a reactor and then sent to another furnace for heating.

BRIEF DESCRIPTION OF THE SEVERAL VIEWS OF THE DRAWINGS

A better understanding of the present invention can be obtained when the following detailed description of some embodiments is considered in conjunction with the following drawings in which.

DETAILED DESCRIPTION OF THE INVENTION

As noted above, what the refiners and fired heater owners need is improved recovery of the thermal energy so that the waste energy can be used without being restricted to aforementioned choices. It would be preferable to utilize the waste thermal energy to increase production capacity of the unit rather than heat auxiliary products or discharge that energy to the atmosphere when heating the auxiliary products is not desired. Increasing production by improved utilization of the waste energy also contributes to the quality of environment in that efficient utilization of energy leads to reduced environmental energy discharge. Techniques and apparatus disclosed herein achieve that aim by increasing production capacity with significantly lower increase in capital cost and provide techniques of efficiently utilizing the energy produced in the fired heaters to increase the output.

Figure 2:
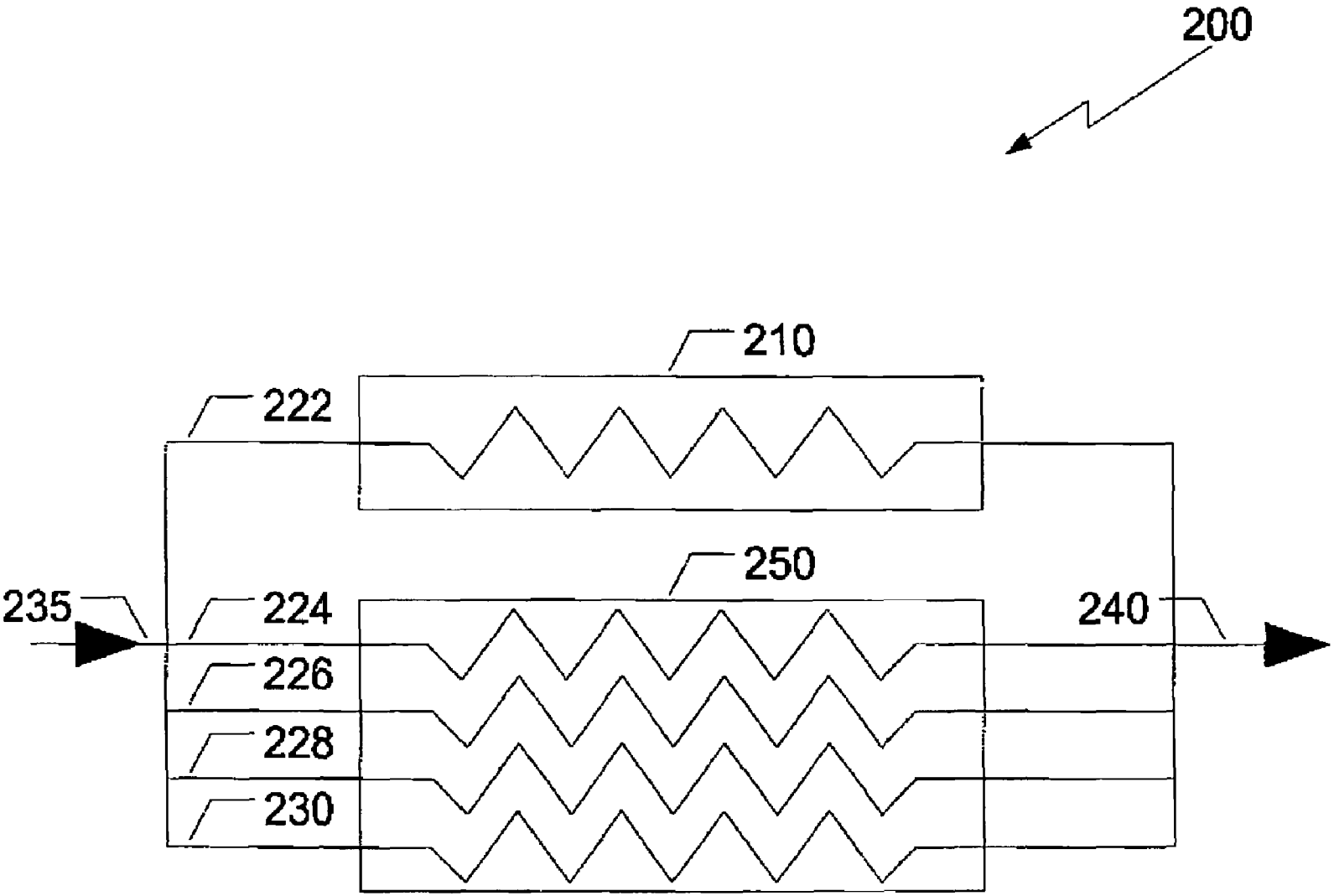
FIG. 2 is a conceptual block diagram of heating of hydrocarbon fluids in a furnace according to the invention.

With reference to FIG. 2, is a conceptual block diagram of heating of hydrocarbon fluids in a furnace 200 according to the invention. A fluid feed line 235 is divided into a first group of fluid passes 222, and a second group of fluid passes 224, 226, 228, and 230, for example. The feed fluid through fluid passes 222, and 224 is heated in the convection section 210, and the feed fluid through fluid passes 224, 226, 228, and 230 is heated in the radiation section 250. The processed fluids are then recombined in the fluid outlet 240. The feed fluid corning out from the fluid outlet 240 may then again be sent through a next fired furnace similar to the furnace 200, and so on until desired products are obtained, or yet another process may need to be performed on the hydrocarbon fluid. Division of fluids into a number of flow paths is well within the skill of those practicing the art.

Figure 1:
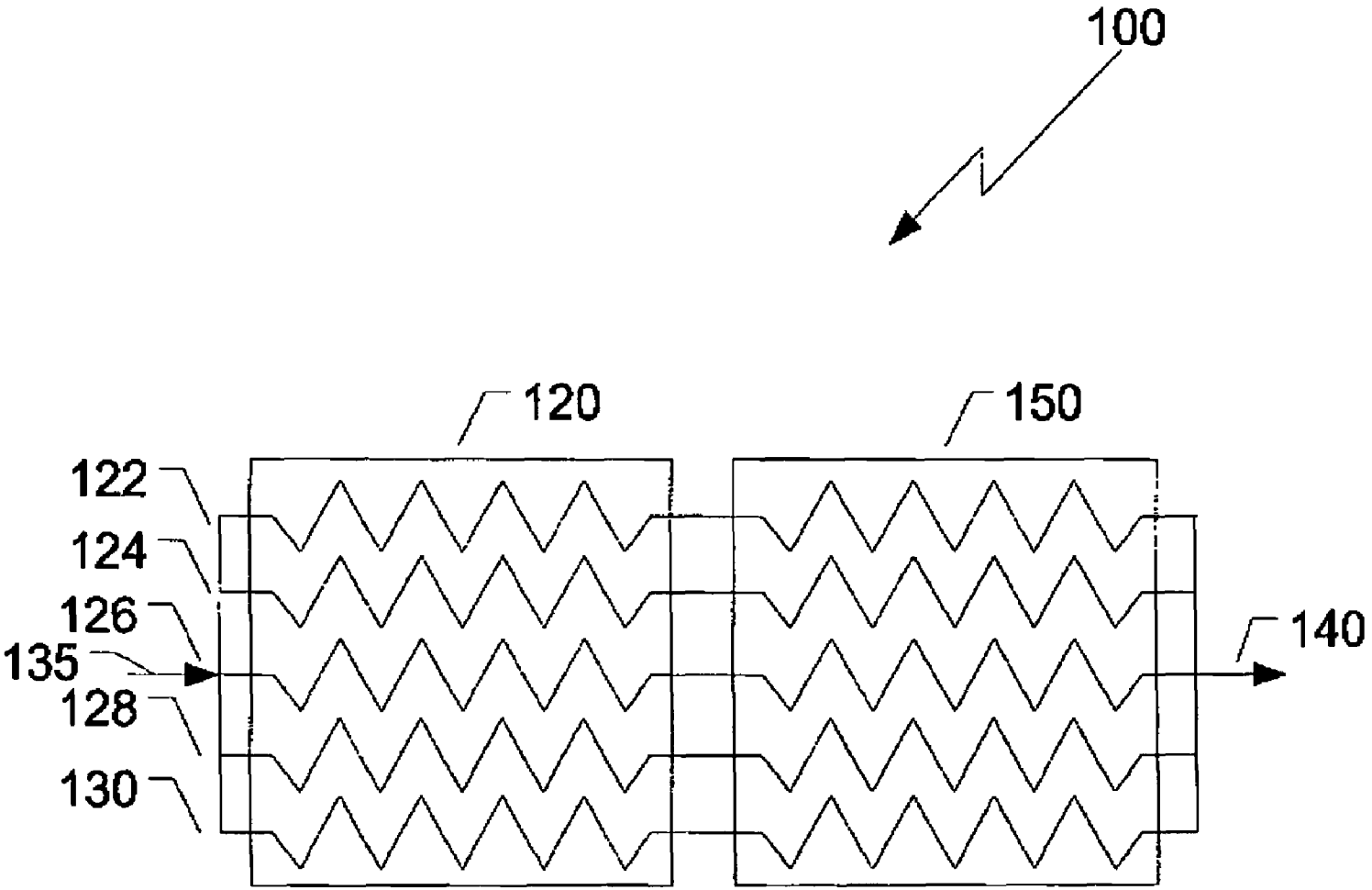
FIG. 1 (PRIOR ART)
FIG. 1 is a conceptual block diagram of typical heating of hydrocarbon fluids in a furnace (prior art).
Figure 3:
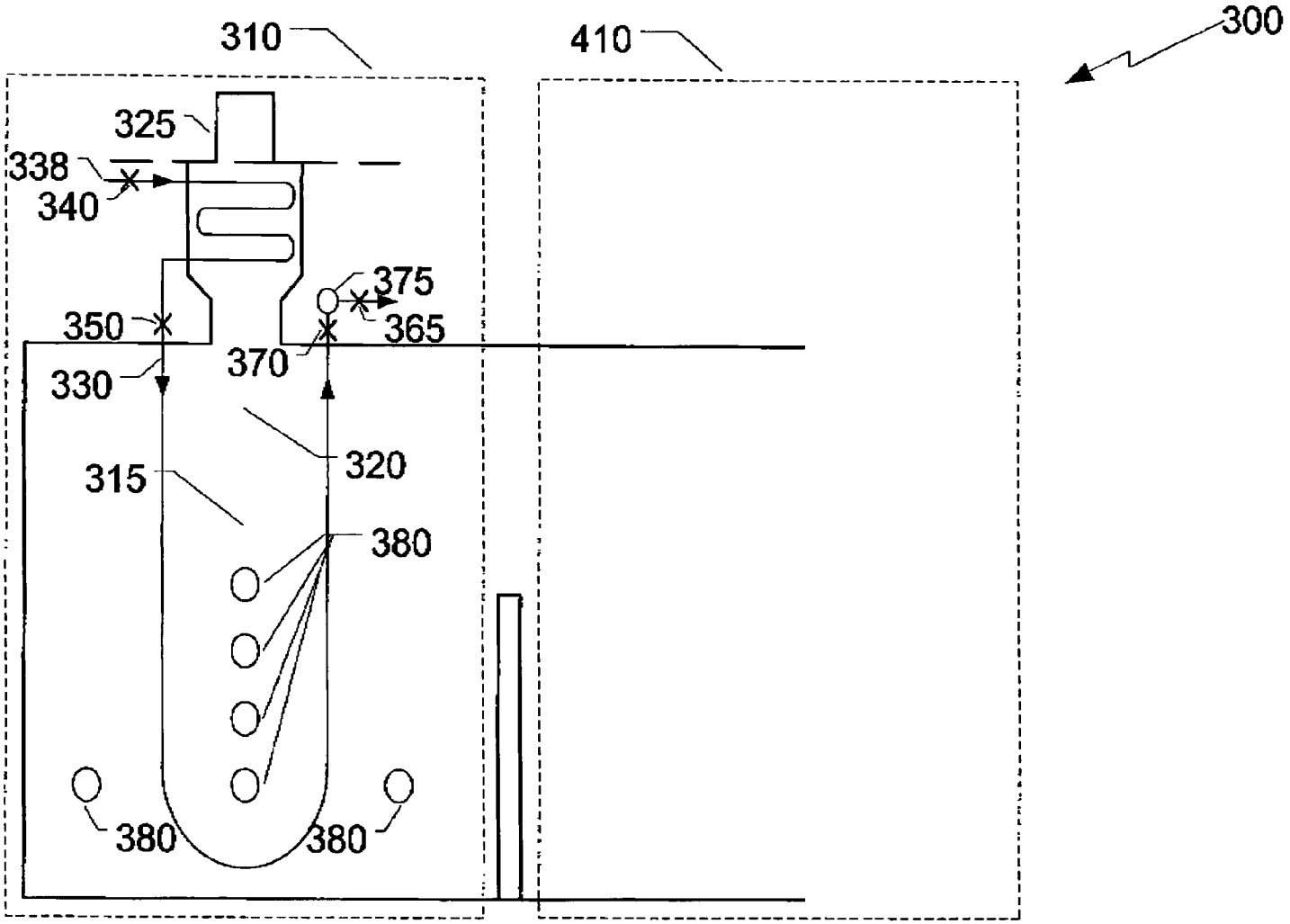
FIG. 3 (PRIOR ART)
FIG. 3 is a diagram depicting a typical example system of heating of hydrocarbon fluids in a furnace (prior art) of FIG. 1.

With reference to FIG. 3 is a diagram depicting a typical example system of heating of hydrocarbon fluids in a furnace (prior art) of FIG. 1. The fired heater 300 as shown has a fired furnace 310 fluidically coupled to a similar fired furnace 310 where output of the furnace 310 is fed as input to the furnace 410. In this manner, a plurality of furnaces may be cascaded to process the hydrocarbon fluids. There may be further processing of the fluid before it is sent from one furnace to the next furnace. The furnace 310 roughly comprises of two sections from the perspective of thermal energy delivery to the input fluids: a radiant (or radiation) section 315, a convection section 320, and a stack section 325 for exhaust of unusable waste energy. The furnace 310 has at least one or more burners 380. The hydrocarbon fluid enters the furnace 310 through path 338. The fluid pressure and temperature are monitored at nodes 340, 350, 370 and 375. There may be an optional manifold valve 375 to control the flow of the hydrocarbon fluids. When the fluid enters through the node 340, it is first heated in the convection section 320, and then heated in the radiant section 315. The fluid heated in the radiant section then exits through the nodes 370 and 365 for further processing as desired.

Following TABLE I shows the pressure and temperature at the input node 340 and output node 365 of an example furnace of the conventional design, with a flow rate of 333,890 Lb/Hr. The TABLE I is further discussed below in the context of the invention to demonstrate the effect of implementing the invention.

TABLE I

| S.N. | Process Conditions | Units | Node 340 | Node 365 |
|---|---|---|---|---|
| 1 | Flow rate | Lb/hr | 333,890 | 333,890 |
| 2 | Opr. Temp. | ° F. | 785 | 985 |
| 3 | Opr. Pres. | Psi | 178.2 | 174.0 |

Figure 4:
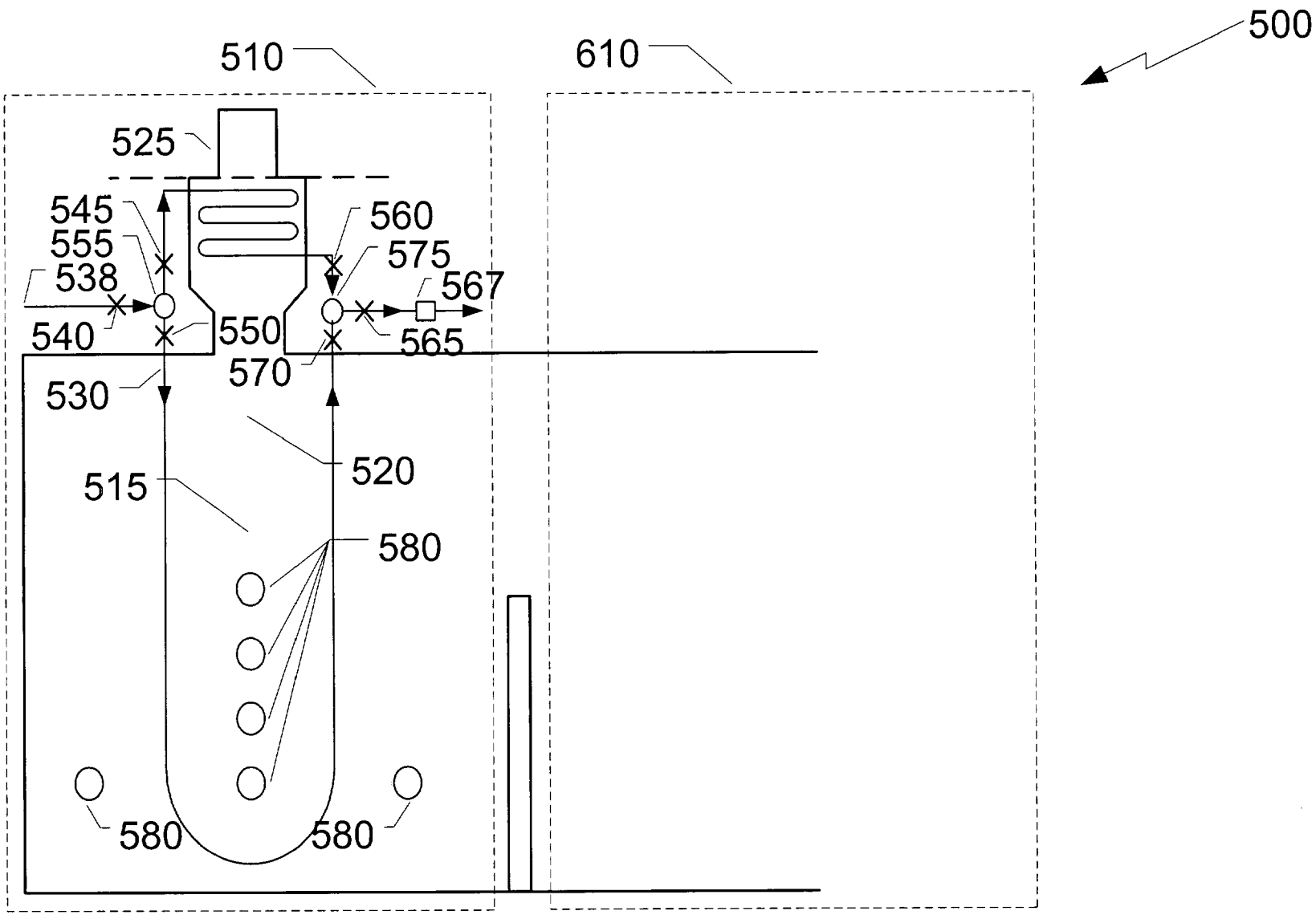
FIG. 4 is a diagram showing an exemplary embodiment according to the invention of FIG. 2 showing division of the fluid flow and heating thereof.

Now referring to FIG. 4, a diagram of an exemplary embodiment of fired heaters 500 according to the invention of FIG. 2 is shown. The fired heater 500 as shown has a fired furnace 510 fluidically coupled to a similar fired furnace 610 where output of the furnace 510 is fed as input to the furnace 610. In this manner, a plurality of furnaces may be cascaded to process the hydrocarbon fluids. The fluid heated in the furnace 510 may be processed in a reactor 567 to perform chemical reactions or other desired processing and then sent to furnace 610 for further heating. Since furnaces 510 and 610 are substantially alike, it would suffice to illustrate the technique and apparatus of the invention with reference to furnace 510.

Again, referring to FIG. 4, the furnace 510 roughly comprises of two sections from the perspective of thermal energy delivery to the input fluids: a radiant (or radiation) section 515, a convection section 520, and a stack section 525 for exhaust of unusable waste energy. The furnace 510 has at least one or more burners 580. An input hydrocarbon fluid path 538 is divided into at least two fluid paths, a first fluid path 530, and a second fluid path 535. In general, each of the fluid paths comprises a plurality of fluid passes. The fluid going into the first fluid path 530 is heated predominantly by radiation heat transfer mechanism. Since the fluid in the first fluid path 530 traverses in fluid passes which are in closer proximity of the burners 580, the heat transfer mechanism is predominantly by radiation and to a secondary extent, the heat transfer mechanism is convection. It is estimated that various fluid passes in the radiation section 515 receive heat energy somewhere between 80–85% through the radiation heat transfer mechanism and remaining energy by the convection heat transfer mechanism. Likewise, it is estimated that various fluid passes in the convection section 520 receive heat energy somewhere between 80–85% through convection heat transfer mechanism and the remaining energy through the radiation heat transfer mechanism. Thus, the nomenclature of naming the sections of the furnaces should be understood to mean as involving the dominant heat transfer mechanism in those sections resulting from the proximity to the burners 580. The estimated percentages may vary significantly in installation to installation due to their geometry and construction materials employed therein.

Referring to FIG. 4 again, a certain fluid pressure at an input node 540 is maintained. The input fluid is divided by means of a divider 555 such that a reasonable fluid pressure differential between a node 550 and a node 560 is maintained. The fluid flow divider 555 may be a manifold, a fixed size orifice, or a manually controllable valve, or an automatically controllable valve that can maintain or control a pressure differential between the node 550 and the node 560. Those skilled in the art may employ numerous other alternatives to maintain such pressure differential. As may be noted the fluid passing through the first path 530 is heated in the radiation section 515, and the fluid passing through the second path 535 is heated in the convection section 520. The fluids after being heated in the radiation section 515 and the convection section 520 are again combined in a manifold 575 for further heat treating and may be sent to another furnace 610 coupled to the furnace 510. The process may be carried out in as many stages as required according to the need of the chemical reaction or the desired product. Table II shows the pressure levels at nodes 540, 545, 550 (input side nodes) and nodes 560, 565, 570 (output side nodes) of an exemplary implementation of the technique utilized in the apparatus illustrated herein.

TABLE II

| S.N. | Process conditions | Units | Node 540 | Node 550 | Node 570 | Node 545 | Node 560 | Node 565 |
|---|---|---|---|---|---|---|---|---|
| 1 | Flow rate | Lb/hr | 333,890 | 258,970 | 258,970 | 74,920 | 74,920 | 333,890 |
| 2 | Opr. Temp. | ° F. | 785 | 785 | 985 | 785 | 985 | 985 |
| 3 | Opr. Pres. | Psi | 178.1 | 178.1 | 175.7 | 178.1 | 175.7 | 175.7 |

Note that the pressure differential between the input side nodes (540, 545, and 550) and the output side nodes (560, 565, and 570) in the exemplary system is merely 2.4 psi. This low-pressure differential attained through the illustrated technique reduces power consumption used in the compressors and thus the size of the compressors may be accordingly reduced to maintain the same fluid flow. Lower pressure differential also permits the reactor operation at lower pressure. The advantageous lower pressure operation may also be utilized in designing relative sizes of the radiant section and the convection section to further optimize performance of a fired heater.

Now referring to Table I and Table II, it can be seen that the fluid pressure drop from the input node 340 to the output node 365 for the conventional fired heater system 300 is 4.2 psi. The corresponding pressure drop from the input node 540 to the output node 565 for the fired heater system of the exemplary illustrated system is mere 2.4 psi, i.e., input to output side pressure drop of the conventional system in this example is about 75% higher than the exemplary system.

Note that the higher pressure drop of the conventional design limits the performance of pumps and compressors and consumes substantial amount of energy. The performance of heaters illustrated in both cases is determined by performing simulations using a widely used computer program known as "DIRECT FIRED HEATERS FNRC-5" developed by PFR Engineering Systems, Inc. of Los Angeles, Calif.

Another major advantage of the technique and the apparatus illustrated herein is the reduction in initial cost resulting due to savings in the required external piping. In the conventional design, the full size inlet manifold and piping needs to be relocated to the convection section. In the illustrated technique, the apparatus, and the system, the size of manifold and piping is substantially reduced.

The techniques and the illustrated apparatus may be used to heat any kind of hydrocarbons fluid with proper adjustment of the size of the apparatus whether for production or development in the laboratories. Such adjustments in the size and routine fabrication details are within the skills of those practicing the art.

The foregoing disclosure and description of the preferred embodiments are illustrative and explanatory thereof, and various changes in the components, the fired heater configurations, and configurations of the techniques, as well as in the details of the illustrated apparatus and techniques of operation may be made without departing from the spirit and scope of the invention as claimed in the appended claims.

What is claimed is:

1. A method of heat treating a hydrocarbon fluid in a fired heater, the method comprising:

a. dividing the hydrocarbon fluid flow into at least a first fluid path and a second fluid path, wherein the hydrocarbon feed fluid flow comprises hydrocarbon vapors and recycle gas;

b. heating the hydrocarbon fluid in the first fluid path by a predominantly radiant heat transfer mechanism forming a first heated hydrocarbon feed;

c. heating the hydrocarbon fluid in the second fluid path by a predominantly convection heat transfer mechanism forming a second heated hydrocarbon feed; and d. recombining the first and second heated hydrocarbon feeds, for transfer to a unit for onward processing;

wherein the fired heater comprises a radiant section and a convection section in parallel configuration.

2. The method as in claim 1, wherein the hydrocarbon feed fluid comprises a mixture of hydrocarbon feed.

3. The method as in claim 1, wherein the dividing the hydrocarbon feed fluid flow comprises channeling the hydrocarbon feed fluid in a desired proportion through the first fluid path and through the second fluid path.

4. The method as in claim 3, wherein the dividing the hydrocarbon feed fluid flow further comprises maintaining a certain pressure differential between the first fluid path and the second fluid path.

5. The method as in claim 1, wherein the heating the hydrocarbon feed fluid comprises providing heat energy to the hydrocarbon feed fluid in the first fluid path and in the second fluid path.

6. A apparatus for heating a first stream of hydrocarbon feed fluid in a first fluid path using predominantly radiation heat transfer mechanism and heating a second stream of hydrocarbon feed fluid in a second fluid path using predominantly convection heat transfer mechanism, wherein the first fluid path and the second fluid path substantially form parallel configuration, the apparatus comprising:

a. a hydrocarbon fluid flow system comprising a plurality of hydrocarbon fluid passes, the plurality of passes comprising at least a first pass and a second pass; and b. at least one heater positioned to provide heat energy by predominantly a radiation heat transfer mechanism to the first pass and to provide heat energy by predominantly convection heat transfer mechanism to the second pass, wherein the radiant section and the convection section are in substantially parallel configuration.

7. The apparatus as in claim 6, wherein the apparatus for heating of hydrocarbon fluids comprises a furnace.

8. The apparatus as in claim 6, wherein the furnace further comprises at least one reactor coupled to the output side of the furnace for accomplishing chemical reaction of the fluid heated in the furnace.

9. The apparatus as in claim 8, wherein the apparatus for heating the hydrocarbon fluids comprises sequentially coupled furnaces to transmit heated fluid flow from a first furnace to a next furnace.

10. The apparatus as in claim 6, wherein the hydrocarbon fluid flow system further comprising: a pressure controller coupled to the fluid flow system to maintain a certain pressure differential range between the first pass and the second pass.

11. The apparatus as in claim 10, wherein the pressure controller is coupled to the first pass and the second pass.

12. The apparatus as in claim 10, wherein the pressure controller is a fixed size restrictive orifice flow divider.

13. The apparatus as in claim 10, wherein the pressure controller is a flow divider manifold valve.

14. The apparatus as in claim 6, wherein the at least one heater is a gas fired heater.

15. The apparatus as in claim 6, wherein the at least one heater is an oil fired heater.

16. A system of heat treating a hydrocarbon fluid in a fired heater, the system comprising:

a. means for dividing the hydrocarbon fluid flow into at least a first fluid path and a second fluid path, wherein the hydrocarbon feed fluid flow comprises hydrocarbon vapors and recycle gas;

b. means for heating the hydrocarbon fluid in the first fluid path by a predominantly radiant heat transfer mechanism forming a first heated hydrocarbon feed;

c. means for heating the hydrocarbon fluid in the second fluid path by a predominantly convection heat transfer mechanism forming a second heated hydrocarbon feed, wherein the second fluid path is substantially parallel to the first fluid path; and d. Means for recombining the first and second heated hydrocarbon feeds, for transfer to a unit for onward processing.

17. The system as in claim 16, wherein the hydrocarbon fluid comprises a mixture of hydrocarbon feed.

18. The system as in claim 16, wherein the means for dividing the hydrocarbon fluid flow comprises furnace plumbing to channel the hydrocarbon fluid in a desired proportion through the first fluid path and through the second fluid path.

19. The system as in claim 18, wherein the means for dividing the hydrocarbon fluid flow further comprises means for maintaining a certain pressure differential between the first fluid path and the second fluid path.

20. The system as in claim 16, wherein the means for heating the hydrocarbon fluid comprises means for providing heat energy to the hydrocarbon fluid in first fluid path and the second fluid path.

21. The method as in claim 1, wherein the onward processing comprises repeating steps a–c on the recombined hydrocarbon feed.

22. The method as in claim 1, wherein the onward processing comprises collecting the recombined hydrocarbon feed as raw material for other products.

23. The method as in claim 1, wherein the onward processing comprises collecting the recombined hydrocarbon feed as a finished product.

* * * * *